US010837329B2

(12) United States Patent
Parrish et al.

(10) Patent No.: US 10,837,329 B2
(45) Date of Patent: Nov. 17, 2020

(54) FLOW CONTROL SYSTEM TO ELIMINATE AIR INGESTION

(71) Applicant: GM GLOBAL TECHNOLOGY OPERATIONS LLC, Detroit, MI (US)

(72) Inventors: Robert Parrish, White Lake, MI (US); Vijay A Neelakantan, Rochester Hills, MI (US); Michael A Fisher, Auburn Hills, MI (US); David J Varda, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 365 days.

(21) Appl. No.: 15/814,881

(22) Filed: Nov. 16, 2017

(65) Prior Publication Data

US 2019/0145295 A1 May 16, 2019

(51) Int. Cl.

| | |
|---|---|
| ***F01M 11/08*** | (2006.01) |
| ***F01M 11/00*** | (2006.01) |
| ***F01M 1/02*** | (2006.01) |

(52) U.S. Cl.

CPC ..... *F01M 11/08* (2013.01); *F01M 1/02* (2013.01); *F01M 11/0004* (2013.01)

(58) Field of Classification Search

CPC ..... F01M 11/08; F01M 1/02; F01M 11/0004

See application file for complete search history.

(56) References Cited

U.S. PATENT DOCUMENTS

| | | | | |
|---|---|---|---|---|
| 4,762,201 | A * | 8/1988 | Malik | F01M 1/12 184/6.13 |
| 5,894,825 | A * | 4/1999 | Duerr | F01M 1/02 123/196 R |
| 6,053,137 | A * | 4/2000 | Trzmiel | F16N 39/002 123/90.17 |
| 8,028,672 | B2 * | 10/2011 | Prior | F01M 1/12 123/196 R |
| 8,739,950 | B2 * | 6/2014 | Lundberg | F15B 21/14 192/48.601 |
| 9,068,645 | B2 * | 6/2015 | Tamai | F16H 57/0447 |
| 9,200,713 | B2 * | 12/2015 | Neelakantan | F16K 11/07 |
| 9,856,931 | B2 * | 1/2018 | Neelakantan | F16D 11/14 |

(Continued)

OTHER PUBLICATIONS

U.S. Appl. No. 15/641,411, filed Jul. 5, 2017 by GM Global Technology Operations LLC.

(Continued)

*Primary Examiner* — Michael A Riegelman

(57) ABSTRACT

A fluid management system, or flow control system, for an automotive propulsion system is provided. The system includes a housing defining a sump configured to collect a volume of liquid and gaseous fluid and a pump configured to pump fluid from the sump. The pump defines a pump inlet and a pump outlet. A conduit is in fluid communication with the pump outlet. A passive valve is disposed within the conduit, the conduit defining a conduit outlet downstream of the passive valve, and the conduit further defining an orifice between the pump and the passive valve. The passive valve allows hydraulic fluid to flow past the valve, while substantially preventing air from flowing past the passive valve. The air is instead bled out through the orifice, along with some of the hydraulic fluid.

16 Claims, 3 Drawing Sheets

(56) References Cited

U.S. PATENT DOCUMENTS

| | | | | |
|---|---|---|---|---|
| 2003/0213650 | A1* | 11/2003 | Tsujihara | F01M 1/02 184/6.9 |
| 2003/0230274 | A1* | 12/2003 | Williams | F01M 1/02 123/196 R |
| 2006/0054404 | A1* | 3/2006 | El-Ibiary | F16C 33/1085 184/6 |
| 2009/0235630 | A1* | 9/2009 | Norris | F01D 25/20 60/39.08 |
| 2012/0061184 | A1* | 3/2012 | Craft | F04C 2/102 184/6.12 |
| 2014/0261281 | A1* | 9/2014 | Jacques | F02B 75/06 123/192.2 |
| 2016/0116053 | A1* | 4/2016 | Nystrom | F16H 57/0435 184/6.1 |
| 2016/0169068 | A1* | 6/2016 | Johnson | F16N 39/00 184/6.24 |
| 2019/0011046 | A1* | 1/2019 | Garcia | F16H 61/0025 |
| 2019/0145295 | A1* | 5/2019 | Parrish | F01M 11/08 184/6.23 |
| 2019/0145440 | A1* | 5/2019 | Fisher | F15B 1/26 60/325 |

OTHER PUBLICATIONS

U.S. Appl. No. 15/814,899, filed Nov. 16, 2017 by GM Global Technology Operations LLC.

* cited by examiner

FLOW CONTROL SYSTEM TO ELIMINATE AIR INGESTION

TECHNICAL FIELD

The present disclosure relates to a sump tank assembly and flow delivery system for pumping hydraulic fluid from the sump tank.

INTRODUCTION

Lubrication systems and hydraulic control systems for propulsion systems on passenger vehicles may be wet or dry sump systems. A wet sump system is typically used on production vehicles in engines and/or transmissions. Hydraulic fluid is stored beneath the propulsion system in an oil pan. The oil pan is typically large and deep in order to hold sufficient amounts of hydraulic fluid to control and lubricate propulsion system components.

During high lateral-G maneuvers, hydraulic fluid typically contains a large quantity of entrained air, which is absorbed into the hydraulic fluid due to splashing during the lubricating process. Entrained air lowers the lubricating efficiency of the fluid.

Further improvements are desired to reduce the complexity and number of components needed in hydraulic sump systems, as well as to reduce the size of the sump housing.

SUMMARY

The present disclosure provides an arrangement of one or more pumps, valves, and orifices that allows passage of hydraulic fluid downstream of the valves, while substantially preventing air from flowing past the valves. The excess air is instead returned to the sump via the orifices.

In one form, which may be combined with or separate from the other forms disclosed herein, a fluid management system for an automotive propulsion system is provided. The fluid management system includes a housing defining a sump configured to collect a volume of liquid and gaseous fluid and a pump configured to pump fluid from the sump. The pump defines a pump inlet and a pump outlet. A conduit is in fluid communication with the pump outlet. A passive valve is disposed within the conduit. The conduit defines a conduit outlet downstream of the passive valve, and the conduit further defines an orifice between the pump and the passive valve.

In yet another form, which may be combined with or separate from the other forms disclosed herein, a flow control system for an automotive propulsion system is provided. The flow control system includes a housing defining a sump configured to collect a volume of hydraulic fluid and air and a pump configured to pump fluid from the sump. The pump defines a pump inlet and a pump outlet. A conduit is in fluid communication with the pump outlet. A passive valve is disposed within the conduit. The conduit defines a conduit outlet downstream of the passive valve, and the conduit further defines an orifice between the pump and the passive valve. The flow control system is configured to bleed out air through the orifice such that hydraulic fluid substantially free of air flows past the passive valve.

Further additional features may be provided, including but not limited to the following: the passive valve being a spring-loaded valve; the passive valve comprising a ball and a spring configured to bias the ball against an opening to seal the opening; the conduit being a first conduit, the pump being a first pump, the pump inlet being a first pump inlet, the pump outlet being a first pump outlet, and the orifice being a first orifice; a second pump configured to pump fluid from the sump; the second pump defining a second pump inlet and a second pump outlet; a second conduit in fluid communication with the second pump outlet; the second conduit defining a second orifice between the second inlet and the outlet; the second conduit being in fluid communication with the first conduit at an intersection disposed downstream of the second orifice; the passive valve being a first passive valve; a second passive valve disposed within the second conduit between the second orifice and the intersection of the first and second conduits; the first and second pump inlets being located at opposite ends of the sump housing; a fluid cooler assembly in fluid communication with the outlet; the passive valve being a shuttle valve having a closing element configured to close off one of the first and second conduits; the closing element being configured to close off the conduit of the first and second conduits that has a lower pressure than the other of the first and second conduits; the passive valve comprising a ball and a spring configured to bias the ball against an opening at a predetermined pressure so that hydraulic fluid substantially free of air that exceeds the predetermined pressure flows past the passive valve; and the flow control system being further configured to bleed out air through the second orifice such that hydraulic fluid substantially free of air flows past the passive valve.

Further aspects, advantages and areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DESCRIPTION

The following description is merely exemplary in nature and is not intended to limit the present disclosure, application, or uses.

Figure 1:
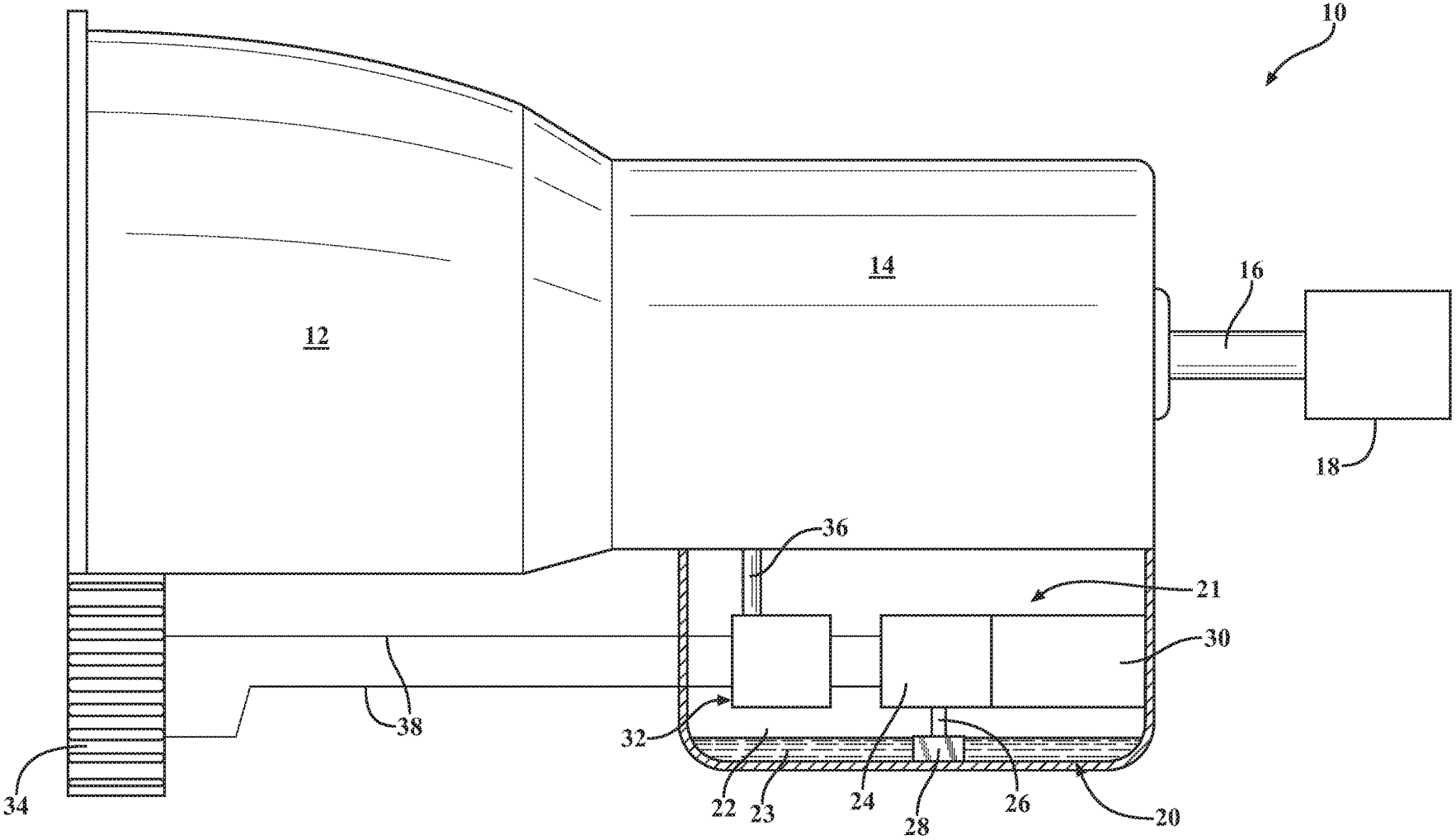
FIG. 1 is a diagrammatic view of a portion of a motor vehicle propulsion system including a fluid management system, in accordance with the principles of the present disclosure.

With reference to FIG. 1, a portion of a motor vehicle propulsion system is illustrated and generally designated by the reference number 10. The propulsion system 10 includes an engine or prime mover 12 that may be an internal combustion engine or hybrid power plant or any other desirable type of engine. The output of the engine 12 is provided to an automatic transmission 14. The automatic transmission 14 typically includes one or more planetary gear assemblies (not shown) connected to an output shaft 16 that is coupled to and drives a final drive assembly 18 which may include a propeller shaft, a differential, axles, wheels and tires (all not illustrated). In the alternative, the transmission 14 may be a CVT transmission having a pair of pulley sets.

In the illustrated example, the automatic transmission 16 includes a valve body or housing 20, typically disposed at the lower or portion of the automatic transmission 16. The housing 20 defines a sump 22, which is a reservoir that collects hydraulic fluid 23 (and air) that typically drains down to the sump 22. One or more hydraulic pumps 24 are disposed in the sump 22 for pumping hydraulic fluid 23 from the sump 22 to other components. Each pump 24 has a pump inlet 26 disposed within the sump 22. The pump inlet 26 may have an intake filter 28 disposed on the end of the pump inlet 26 in the sump 22 to provide filtered hydraulic fluid (transmission oil) 23 to the inlet 26 of the hydraulic pump 24. The pump 24 and the sump 22 are components of a fluid management system, or flow control system 21, for delivering fluid 23 within the propulsion system 10.

The hydraulic pump 24 may be driven by an electric motor 30 and provides pressurized hydraulic fluid 23 to, among other devices in the automatic transmission 16, a hydraulic control system 32 and an air-to-oil cooler (ATOC) or fluid cooler assembly 34. The hydraulic control system 32 selectively provides pressurized hydraulic fluid 23 through fluids lines 36 to clutches and components of the transmission 14 to control and lubricate components of the transmission 14. The hydraulic control system 32 may also provide hydraulic fluid 23 through lines 38 to the transmission oil cooler (ATOC) 34, which may be disposed in the vehicle radiator (not illustrated).

Figure 2:
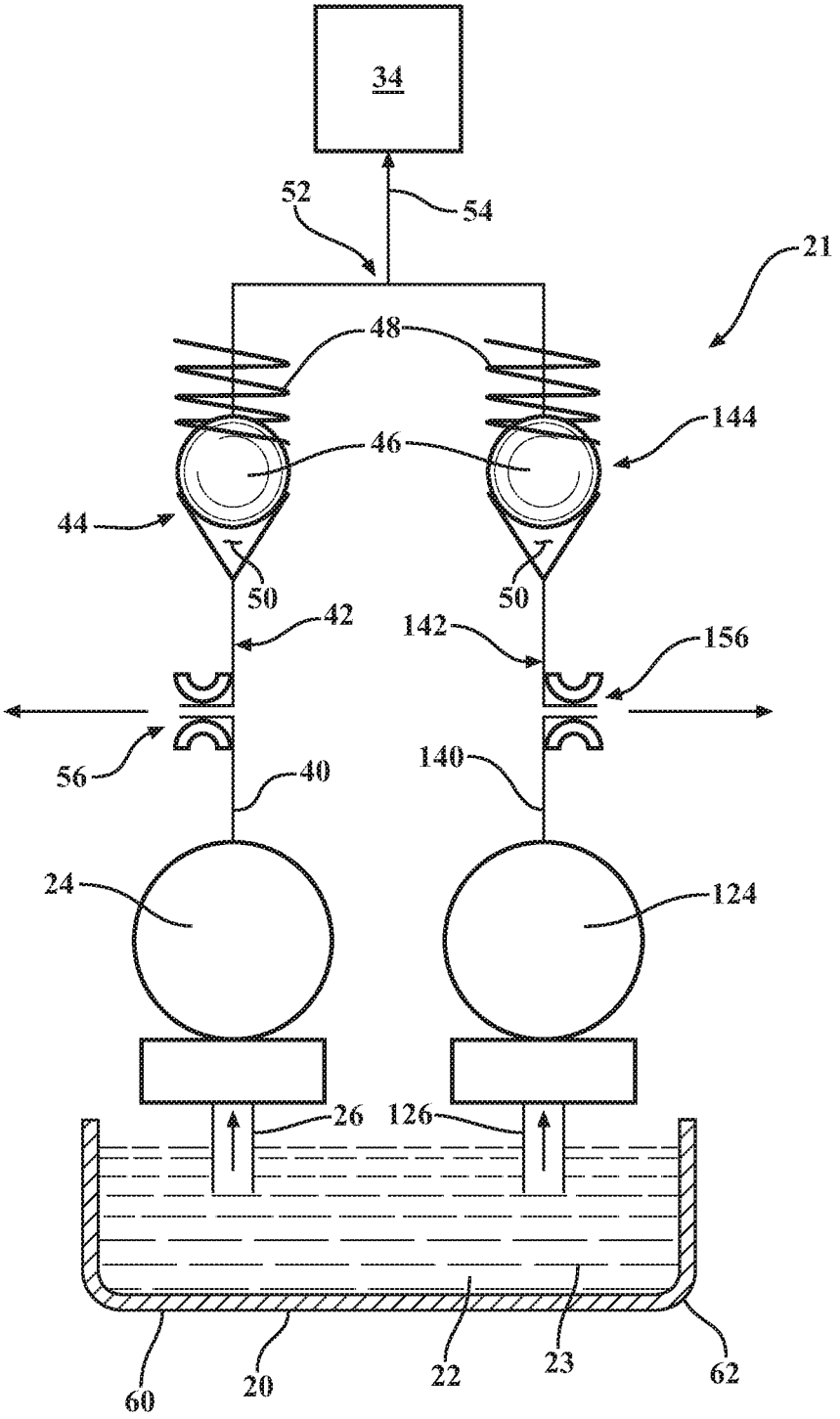
FIG. 2 is a diagrammatic view of the fluid management system of the propulsion system of FIG. 1, according to the principles of the present disclosure.

Referring now to FIG. 2, additional details of a fluid management system (or flow control system) 21 are illustrated. In the example of FIG. 2, two pumps 24, 124 are provided to pick up hydraulic fluid 23 from the sump 22. Each pump 24, 124 defines a pump inlet 26, 126 and a pump outlet 40, 140 and is configured to pump fluid from the sump 22. A first conduit 42 is in fluid communication with the first pump outlet 40, and a second conduit 142 is in fluid communication with the second pump outlet 140.

A first passive valve 44 is disposed within the first conduit 42, and a second passive valve 144 is disposed within the second conduit 142. The passive valves 44, 144 may be spring-loaded ball check valves, as shown, that each include a ball 46 and a spring 48 configured to bias the ball 46 against an opening 50.

The first conduit 42 and the second conduit 142 are in fluid communication each other at an intersection 52 disposed downstream of the passive valves 44, 144. An outlet 54 of the conduits 42, 142 may be disposed downstream of the intersection 52 of the conduits 42, 142. In this case, the conduit outlet 54 communicates with the fluid cooler assembly 34, but the conduit outlet 54 could alternatively be in fluid communication with another component of the propulsion system 10.

The first conduit 42 defines an orifice 56 between the first pump 24 and the first passive valve 44, and the second conduit 142 defines a second orifice 156 between the second pump 124 and the second passive valve 144.

As fluid sloshes around in the sump 22, air may become entrained in the hydraulic fluid 23, which is often undesirable for pumping to other components, such as the fluid cooler assembly 34. The flow control system 21 is configured to bleed out air through the orifices 56, 156 such that hydraulic fluid 23 substantially free of air flows past the passive valves 44, 144. The springs 48 of the passive valves 44, 144 bias the balls 46 against the valve openings 50 to prevent low pressure fluid 23 (that contains air) from substantially flowing past the openings 50 of the valves 44, 144. The valves 44, 144 are biased closed at a predetermined pressure so that only hydraulic fluid 23 that is substantially free of air (that exceeds the predetermined pressure) flows past the passive valves 44, 144. The air and a relatively small amount of fluid 23 bleeds out of the orifices 56, 156 to be returned to the sump 22. Therefore, hydraulic fluid 23 substantially free of air flows past the passive valves 44, 144.

In some designs, about 5% of the hydraulic fluid 23 is bled out through each of the orifices 56, 156, for a total of 10% fluid loss through the orifices 56, 156, and the rest of the hydraulic fluid 23 is delivered through the passive valves 44, 144 to the conduit outlet 54, and in this case, to the fluid cooler assembly 34. As such, the orifices 56, 156 may be sized to allow air to bleed out through the orifices 56, 156 without allowing too great an amount of hydraulic fluid 23 to escape through the orifices 56, 156. In some examples, the orifices 56, 156 may have diameters in the range of 2-3 mm. In another example, the orifices 56, 156 may have diameters less than 10 mm, or less than 7 mm.

Figure 3:
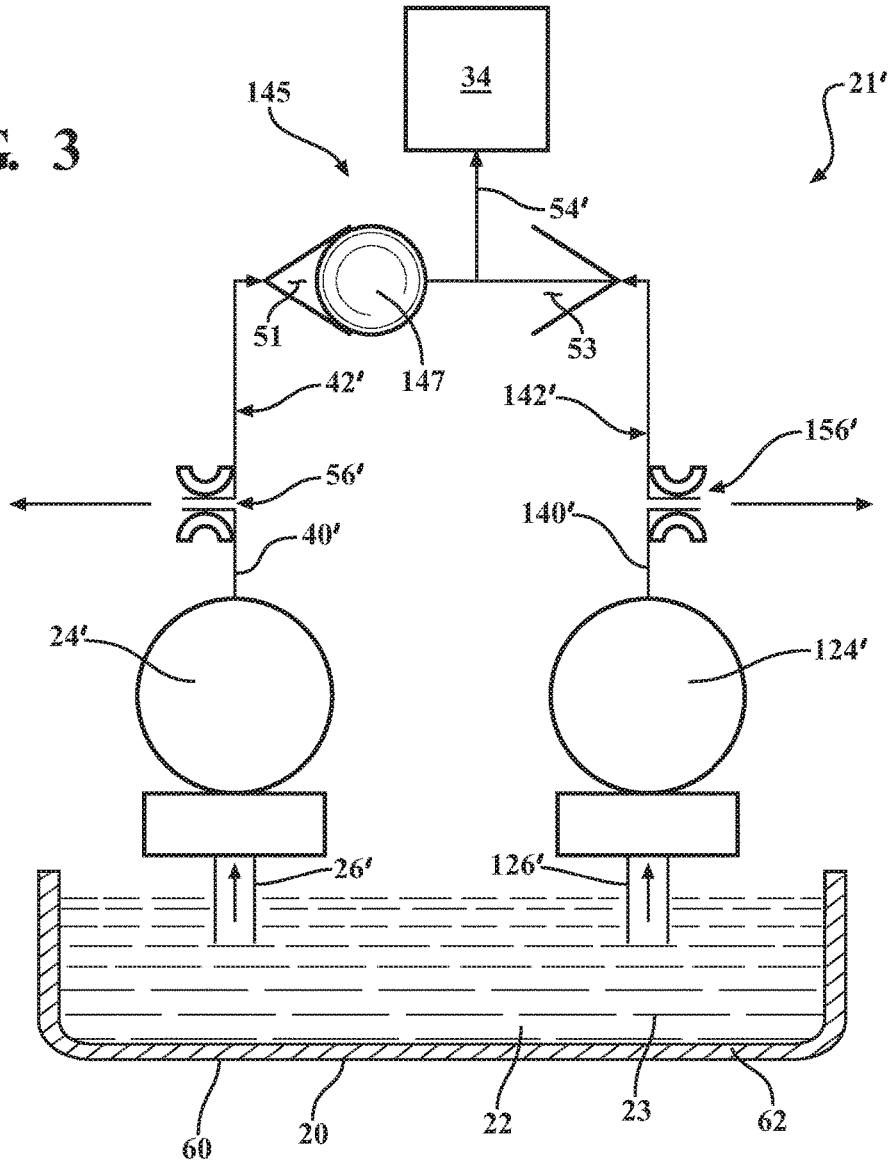
FIG. 3 is a diagrammatic view of another variation of the fluid management system of the propulsion system of FIG. 1, according to the principles of the present disclosure.

Referring now to FIG. 3, another variation of the fluid management system (or flow control system) for use in the propulsion system 10 is illustrated and generally designated at 21'. In the example of FIG. 3, two pumps 24', 124' are provided to pick up hydraulic fluid 23 from the sump 22. Each pump 24, 124 defines a pump inlet 26', 126' and a pump outlet 40', 140' and is configured to pump fluid from the sump 22. A first conduit 42' is in fluid communication with the first pump outlet 40', and a second conduit 142' is in fluid communication with the second pump outlet 140'.

A passive valve, such as a shuttle valve 145, is disposed in fluid communication with the first conduit 42', the second conduit 142', and a conduit outlet 54'. The shuttle valve 145 has a closing element, such as a ball 147, configured to close off one of the conduits 42', 142' and allow fluid 23 to flow through the other conduit 42', 142'. Due to hydraulic pressure, the ball 147 will close off the conduit 42', 142' that has the lower pressure of the two conduits 42', 142' because the higher pressure side of the valve 145 will push the ball 145 toward the lower pressure side.

In FIG. 3, the ball 145 presses against an opening 51 that is in fluid communication with the first conduit 42' to close off the first conduit 42'. An opening 53 that is in fluid communication with the second conduit 142' is open and in fluid communication with the conduit outlet 54' in FIG. 3 because the second conduit 142' has greater fluid pressure than the first conduit 42' in the illustrated configuration.

The first conduit 42' defines an orifice 56' between the first pump 24' and the shuttle valve 145, and the second conduit 142' defines a second orifice 156' between the second pump 124' and the shuttle valve 145. The orifices 56', 156' may be substantially similar to the orifices 56, 156 described above with respect to FIG. 2.

Like the flow control system 21 described above, the flow control system 21' is configured to bleed out air through the orifices 56', 156' such that hydraulic fluid 23 substantially free of air flows past the shuttle valves 145. The shuttle valve 145 closes off the lower pressure conduit 42', 142' that has the most air entrained in the fluid 23.

Figure 4:
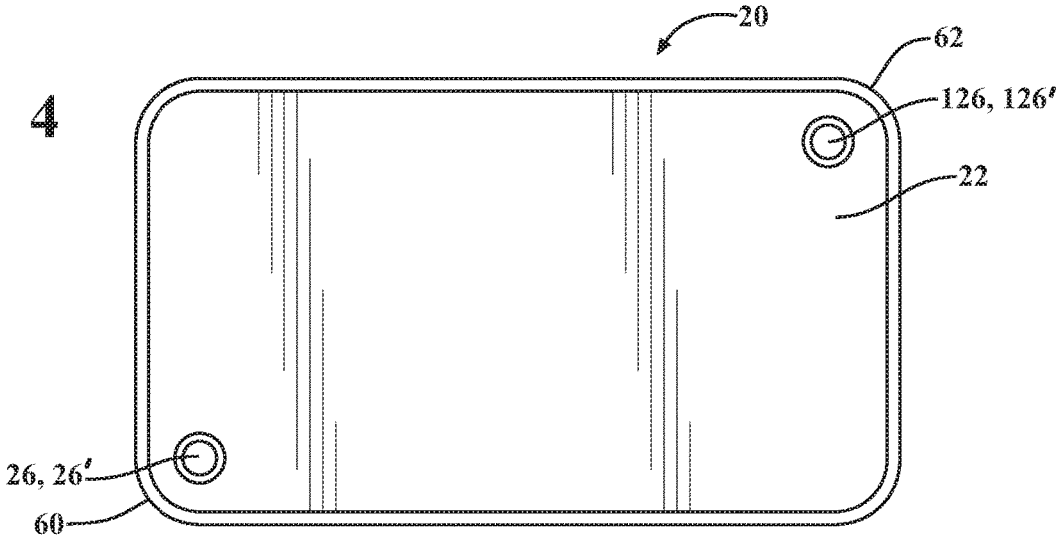
FIG. 4 is a diagrammatic plan view of a sump housing of the fluid management systems of FIGS. 1-3, in accordance with the principles of the present disclosure.

Referring to FIG. 4, a plan view of the sump housing 20 is illustrated. The first pump inlet 26, 26' and the second pump inlet 126, 126' are located at opposite ends 60, 62 of the sump housing 20. Accordingly, as high lateral-G moves are made, fluid 23 is likely to cover at least one of the inlets 26, 26', 126, 126'.

The description is merely exemplary in nature and variations that do not depart from the gist of the disclosure are intended to be within the scope of the disclosure. Such variations are not to be regarded as a departure from the spirit and scope of the disclosure.

What is claimed is:

1. A fluid management system for an automotive propulsion system, comprising:

a housing defining a sump configured to collect a volume of liquid and gaseous fluid;

a first pump configured to pump fluid from the sump, the first pump defining a first pump inlet and a first pump outlet;

a first conduit in fluid communication with the first pump outlet; and a spring-loaded passive valve disposed within the first conduit, the first conduit defining a conduit outlet downstream of the passive valve, the first conduit further defining a first orifice between the first pump and the passive valve, the passive valve comprising a ball and a spring configured to bias the ball against an opening in the passive valve, the fluid management system further comprising a second pump configured to pump fluid from the sump, the second pump defining a second pump inlet and a second pump outlet, and a second conduit in fluid communication with the second pump outlet, the second conduit defining a second orifice between the second pump and the conduit outlet, the second conduit being in fluid communication with the first conduit at an intersection disposed downstream of the second orifice.

2. The fluid management system of claim 1, the passive valve being a first passive valve, the fluid management system further comprising a second passive valve disposed within the second conduit between the second orifice and the intersection of the first and second conduits.

3. The fluid management system of claim 2, the first and second pump inlets being located at opposite ends of the housing defining the sump.

4. The fluid management system of claim 3, further comprising a fluid cooler assembly in fluid communication with the conduit outlet.

5. A fluid management system for an automotive propulsion system, comprising:

a housing defining a sump configured to collect a volume of liquid and gaseous fluid;

a first pump configured to pump fluid from the sump, the first pump defining a first pump inlet and a first pump outlet;

a first conduit in fluid communication with the first pump outlet; and a passive valve disposed within the first conduit, the first conduit defining a conduit outlet downstream of the passive valve, the first conduit further defining a first orifice between the first pump and the passive valve, the fluid management system further comprising a second pump configured to pump fluid from the sump, the second pump defining a second pump inlet and a second pump outlet, and a second conduit in fluid communication with the second pump outlet, the second conduit defining a second orifice between the second pump and the conduit outlet, the second conduit being in fluid communication with the first conduit at an intersection disposed downstream of the second orifice.

6. The fluid management system of claim 5, the passive valve being a shuttle valve having a closing element configured to close off one of the first and second conduits, wherein the closing element is configured to close off the conduit of the first and second conduits that has a lower pressure than the other of the first and second conduits.

7. The fluid management system of claim 6, the first and second pump inlets being located at opposite ends of housing defining the sump.

8. The fluid management system of claim 7, further comprising a fluid cooler assembly in fluid communication with the conduit outlet.

9. A flow control system for an automotive propulsion system, comprising:

a housing defining a sump configured to collect a volume of hydraulic fluid and air;

a pump configured to pump fluid from the sump, the pump defining a pump inlet and a pump outlet;

a conduit in fluid communication with the pump outlet; and a passive valve disposed within the conduit, the conduit defining a conduit outlet downstream of the passive valve, the conduit further defining an orifice between the pump and the passive valve, the flow control system being configured to bleed out air through the orifice such that hydraulic fluid substantially free of air will flow past the passive valve.

10. The flow control system of claim 9, the passive valve being a spring-loaded valve.

11. The flow control system of claim 10, the passive valve comprising a ball and a spring configured to bias the ball against an opening at a predetermined pressure so that hydraulic fluid substantially free of air that exceeds the predetermined pressure may flow past the passive valve.

12. The flow control system of claim 9, the conduit being a first conduit, the pump being a first pump, the pump inlet being a first pump inlet, the pump outlet being a first pump outlet, and the orifice being a first orifice, the fluid management system further comprising a second pump configured to pump fluid from the sump, the second pump defining a second pump inlet and a second pump outlet, and a second conduit in fluid communication with the second pump outlet, the second conduit defining a second orifice between the second pump and the conduit outlet, the second conduit being in fluid communication with the first conduit at an intersection disposed downstream of the second orifice, the flow control system being further configured to bleed out air through the second orifice such that hydraulic fluid substantially free of air may flow past the passive valve.

13. The flow control system of claim 12, the passive valve being a first passive valve, the flow control system further comprising a second passive valve disposed within the second conduit between the second orifice and the intersection of the first and second conduits.

14. The flow control system of claim 13, the first and second pump inlets being located at opposite ends of the housing defining the sump.

15. The flow control system of claim 14, further comprising a fluid cooler assembly in fluid communication with the conduit outlet.

16. The flow control system of claim 9, the passive valve being a shuttle valve having a closing element configured to close off one of the first and second conduits, wherein the closing element is configured to close off the conduit of the first and second conduits that has a lower pressure than the other of the first and second conduits.

* * * * *